US007219742B2

(12) United States Patent
Smith et al.

(10) Patent No.: US 7,219,742 B2
(45) Date of Patent: May 22, 2007

(54) METHOD AND APPARATUS TO COMPLETE A WELL HAVING TUBING INSERTED THROUGH A VALVE

(75) Inventors: David Randolph Smith, Kilgore, TX (US); Gary O. Harkins, Bakersfield, CA (US); Brent Shanley, Bakersfield, CA (US)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 11/277,304

(22) Filed: Mar. 23, 2006

(65) Prior Publication Data

US 2006/0169459 A1 Aug. 3, 2006

Related U.S. Application Data

(62) Division of application No. 10/708,338, filed on Feb. 25, 2004, now Pat. No. 7,082,996.

(60) Provisional application No. 60/319,972, filed on Feb. 25, 2003.

(51) Int. Cl.
*E21B 23/02* (2006.01)
*E21B 43/10* (2006.01)

(52) U.S. Cl. ..... 166/372; 166/382; 166/208

(58) Field of Classification Search ..... 166/90.1, 166/117.7, 120, 126, 129, 142
See application file for complete search history.

(56) References Cited

U.S. PATENT DOCUMENTS

| | | | | |
|---|---|---|---|---|
| 2,906,342 A | | 9/1959 | Russell et al. | 166/115 |
| 3,036,635 A | | 5/1962 | Corley, Jr. et al. | 166/67 |
| 3,726,341 A | | 4/1973 | Holbert, Jr. | 166/224 |
| 3,871,447 A | * | 3/1975 | Crowe | 166/120 |
| 4,305,465 A | * | 12/1981 | Ellis | 166/382 |
| 4,310,051 A | | 1/1982 | Mott | 166/323 |
| 4,350,205 A | | 9/1982 | Goldschild et al. | 166/375 |
| 4,373,584 A | * | 2/1983 | Silberman et al. | 166/117.7 |
| 4,432,417 A | * | 2/1984 | Bowyer | 166/120 |
| 4,832,128 A | | 5/1989 | Light et al. | 166/377 |
| 5,372,202 A | | 12/1994 | Dallas | 166/386 |
| 5,465,793 A | | 11/1995 | Pringle | 166/319 |
| 5,831,156 A | | 11/1998 | Mullins | 73/152.18 |

(Continued)

FOREIGN PATENT DOCUMENTS

WO WO 02/072996 A1 9/2002

OTHER PUBLICATIONS

EPO Supplemental European Search Report, dated Jun. 21, 2006. Application No. EP 04 71 4605, filed Feb. 25, 2004.

(Continued)

*Primary Examiner*—Frank Tsay
(74) *Attorney, Agent, or Firm*—Howrey LLP

(57) ABSTRACT

A method and apparatus for inserting a small diameter continuous hydraulic conduit or capillary tube down a well bore is presented. The methods and apparatus allow either the injection of chemicals to enhance production of oil and gas, or to provide a conduit for production up through the small diameter tubing in marginal wells, into a hanger below a well valve to permit its removal from below the valve if the valve should be required to be closed and its reinsertion without pulling the tubing from the well bore.

10 Claims, 11 Drawing Sheets

U.S. PATENT DOCUMENTS

| | | | | |
|---|---|---|---|---|
| 6,179,056 | B1 | 1/2001 | Smith | 166/313 |
| 6,209,633 | B1 | 4/2001 | Haynes | 166/72 |
| 6,328,111 | B1 | 12/2001 | Bearden et al. | 166/381 |
| 6,491,102 | B2 | 12/2002 | Leismer et al. | 166/316 |
| 6,577,244 | B1 | 6/2003 | Clark et al. | 340/854.6 |
| 7,082,996 | B2 | 8/2006 | Smith et al. | 166/305.1 |

OTHER PUBLICATIONS

PCT Search Report and Written Opinion, dated Sep. 20, 2006. PCT Application Serial No. PCT/US05/05571, filed Feb. 25, 2004.

* cited by examiner

METHOD AND APPARATUS TO COMPLETE A WELL HAVING TUBING INSERTED THROUGH A VALVE

CROSS-REFERENCE TO RELATED APPLICATION

This application is a divisional of U.S. application Ser. No. 10/708,338 filed Feb. 25, 2004 now U.S. Pat. No. 7,082,996, which claims the benefit of U.S. Provisional Application Ser. No. 60/319,972 filed Feb. 25, 2003 entitled Method and Apparatus to Complete a Well Having Tubing Inserted Through a Valve. Both applications are incorporated by reference herein.

BACKGROUND OF THE INVENTION

1. Field of the Invention

The present invention relates to a method and apparatus for maintaining a capillary tube or a small diameter continuous hydraulic conduit in a well bore to inject fluids into or produce fluids from a well; specifically, the method and apparatus for inserting a capillary tube through a well head and production tubing past the wellhead master valves and/or a down hole safety valve and selectively removing the capillary tube if the valve must be closed and reinserting the tube when the valve is re-opened 2. Description of the Related Art In the drilling and completion of oil and gas wells throughout the world, the need to insert small diameter continuous hydraulic conduits or tubes into the well's production tubing has arisen on numerous occasions and for a variety of purposes. Typically, this was accomplished by lowering the continuous hydraulic conduit through the well head, it's master valves, and then down through the production tubing, through any sub-surface safety valves and on down into the well bore from a surface spool system. Substantial cost savings result from the ability to quickly move onto a wellhead site and dispose a small diameter conduit down the well bore without the need of workover rigs or large coiled tubing injector head assemblies. Previously, when the treatment or task was completed, the tubing was withdrawn from the well bore, since it was imprudent to leave a conduit or tube suspended through a safety valve or well head master valve. Very often, it is beneficial to leave the small diameter tubing in the well bore, for example, to chemically treat the well below the safety valve or well head master valves; as, for example, by extending the tube on down the well bore to the production zone. Since these tubes extend past both the well head valves and one or more downhole safety valves, if the well pressures must be controlled, the small diameter continuous hydraulic conduit must be capable of being withdrawn from the well bore before the wellhead valve or the downhole safety valve is closed.

The ability to selectively or automatically move the small diameter continuous hydraulic conduit into and out of a well valve without completely removing the conduit from the well has heretofore not been accomplished.

BRIEF SUMMARY OF THE INVENTION

The present invention discloses a system for manipulating a continuous hydraulic conduit in a producing well. The system is made up of an extraction device providing a longitudinal passage and a piston moveable in said longitudinal passage attached to a first continuous hydraulic conduit. Attached to the end of the first continuous hydraulic conduit is a stinger providing a profile on its outer lateral surface to engage a tubing hanger assembly. When setting the tubing hanger, a setting stinger is used to move the hanger to the desired position, then pressure on the continuous tubing is released, which thereby releases the tubing hanger to set in the lateral surface of the tubular member. The setting stinger is then removed and the production stinger is inserted into the polished bore of the tubing hanger thereby providing continuous hydraulic communication to the tubing hung below in the tubing hanger.

The system is connected to a hydraulic control system for delivery of hydraulic pressure to a well valve and to the extraction device with hydraulic attachment fittings, so that the hydraulic pressure on the well valve and on the piston may be controlled to selectively move the piston down when inserting the stinger in the tubing hanger and selectively move the piston up when removing the conduit out of the hanger and past the closing well valve. A tubing hanger assembly for insertion below a well valve provides a polished bore through its longitudinal axis, and is attachable to the well bore and provides attachment to a second continuous hydraulic conduit which can be suspended from the hanger to the production zone of the well. The system can provide a check valve at the end of the conduit to prevent ingress of well fluids into the hydraulic conduit. The system can also be deployed without a check valve to produce fluids up the continuous hydraulic conduit formed by the insertion of the sealing section into the polished bore below the valve. A second conduit hangs from the tubing hanger located adjacent and below the well valve which must be able to close, to the production zone so that the treatments introduced into the well can be introduced where such treatments are most efficacious or, alternatively, to allow the production of fluids up the well.

The tubing hanger provides a landing tool having an enlarged upper throat to facilitate the guidance of the sealing stinger into the polished bore, which allows well fluids to flow up the well bore past the tubing hanger and a longitudinally spaced polished bore for accepting the setting stinger connected to the distal end of the first continuous hydraulic conduit; said stinger providing at least one hydraulic port communicating from its interior to its lateral exterior face, further providing a groove to activate a latching piston and providing dynamic seals for sealingly engaging the interior surface of the polished bore of the tubing hanger. The first hydraulic port on the interior surface of the landing tool communicates with the continuous hydraulic conduit selectively activating a latching piston, which engages a lateral surface on the slick stinger. This permits the first hydraulic conduit to act as a setting line when pressure is introduced through the conduit to hold the latch in engagement with the tubing hanger. A second hydraulic port on the interior surface of the landing tool communicates with the continuous hydraulic conduit for engaging a plurality of slips which are held out of engagement from the inner surface of the well tubing or casing until pressure is released or lowered in the latched tubing hanger assembly from the control panel at the surface. This lower pressure permits the springs that hold the slips from engagement to overcome the hydraulic pressure from the continuous conduit and move into engagement. As the slips engage the inner surface of the tubing or casing, the weight of the second continuous hydraulic conduit sets the teeth on the outer surface of the slips to bite the casing or tubing.

A tubing hanger supports a second length of continuous hydraulic conduit in a well bore to allow continuous fluid communication from the surface through the distal end of the first continuous hydraulic conduit to the distal end of said second continuous hydraulic conduit as previously described.

A production stinger is inserted in the polished bore of the tubing hanger which thereby allows fluid communication from the well head through the first hydraulic conduit into the second hydraulic conduit to the production zone. As previously noted, when pressure drops on a safety valve, the extraction device removes the first hydraulic conduit past the safety valve allowing it to close to seal the well off. In an alternative embodiment, the stinger on the production stinger is fabricated from a frangible material to break if the stinger is not removed before the safety valve is closed.

DETAILED DESCRIPTION OF THE INVENTION

Figure 1:
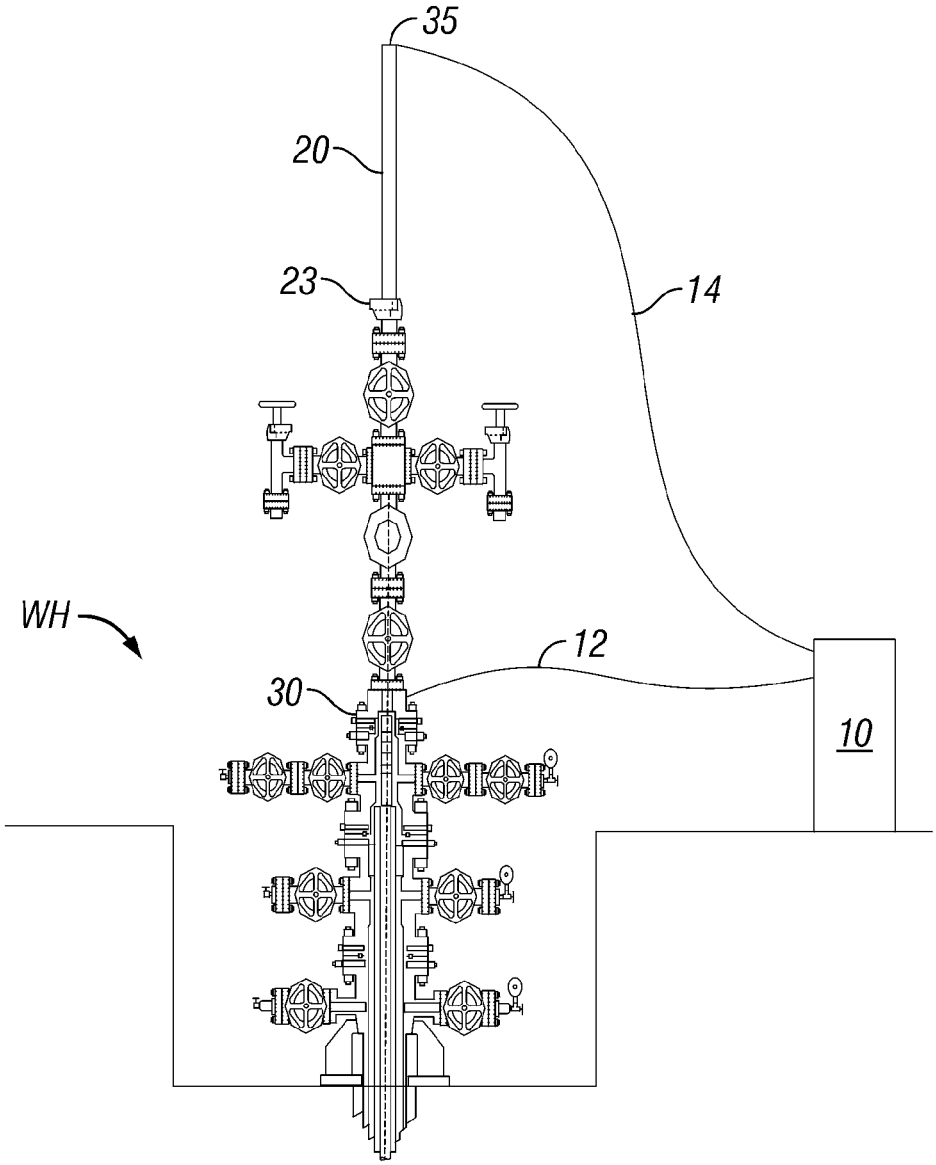
FIG. 1 is a schematic view of the hydraulic control panel and extraction device of the present invention with the hydraulic lines disposed on a wellhead.

FIG. 1 discloses the surface portion of the present invention. A wellhead WH is set over a producing well. Wellhead WH provides a number of valves permitting fluid communication with various tubulars hung in the well bore. When a well is completed, the operator or driller will frequently insert a down hole valve (or safety valve) and a hydraulic control tube extending down the well parallel to the production tubing with the hydraulic tube located on the outside diameter of the production tubing which may be actuated by the release of hydraulic pressure to close off flow through the valve. These control valves are normally held open with hydraulic pressure and the release of pressure causes them to close. Additionally, the valves (by way of example only, at 30) at the well head WH can be hydraulically actuated automatically to shut off a well that experiences a leak in the hydraulic control line that controls the valve or any catastrophic failure of the well, for example the platform is destroyed by fire, explosion, hurricane, or a ship hits it, then the down hole valves will close as the surface destruction of the platform and/or well head will cause the pressure in the control system to leak pressure. Various hydraulic control systems can be used to control the actuation of these hydraulically actuated valves. Control panel 10 is a schematic of any number of control panels that open and close hydraulic pressure. Hydraulic line 12 can be connected to either a wellhead valve or to a downhole safety valve as required in a manner well known to those skilled in the art. Hydraulic line 14 is connected to the hydraulic port of the extraction device 20 which is connected to the top of the well head WH by knock off connector 23. Control panel 10 can selectively and automatically activate, in a staged manner, pressure through line 14 to move a piston in extraction device 20 to engage or disengage a continuous hydraulic conduit from a polished bore and thereby removing the hydraulic line past a well valve which may then be closed as a result of activation of the control panel 10 by any leak in the hydraulic system of the safety valve.

Figure 2:
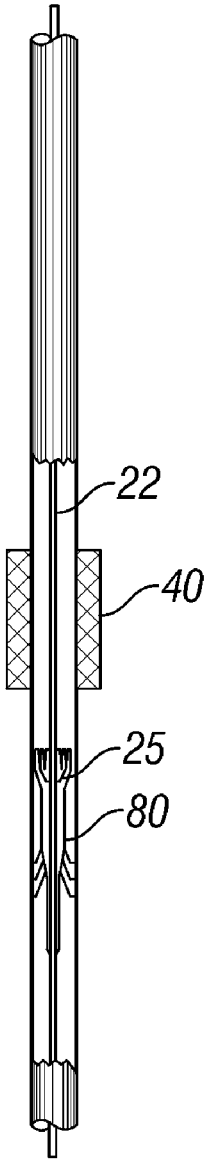
FIG. 2 is a schematic side view of a tubing hanger with the slick stinger inserted in a polished bore therethrough.
Figure 3:
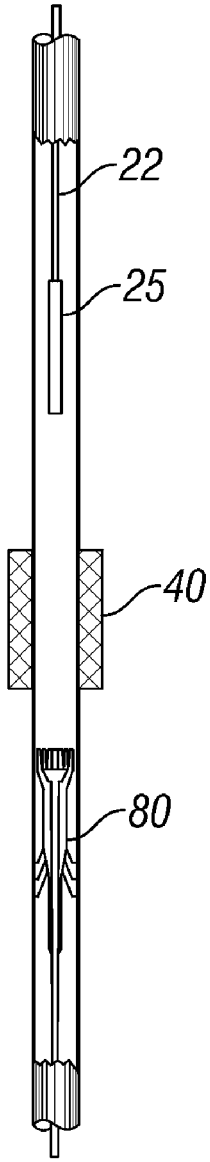
FIG. 3 is a schematic side view of the tubing hanger of FIG. 2 depicting the slick stinger withdrawn from the polished bore.

FIG. 2 is a schematic view of the tubing hanger providing the means for inserting the distal end of the hydraulic conduit from the surface into a polished bore which mates and seals the conduit to a second hydraulic conduit which is set by the tubing hanger in the well. Since the tubing hanger 80 is adjacent and below safety valve 40, in order for safety valve 40 to close, the hydraulic line 22 to which is attached the production stinger 25, must be withdrawn up the well bore to a point above the safety valve 40. Once withdrawn above as more clearly shown in FIG. 3, by manipulation of extraction device 20 shown in FIG. 1, safety valve 40 may be safely and effectively closed.

Figure 4:
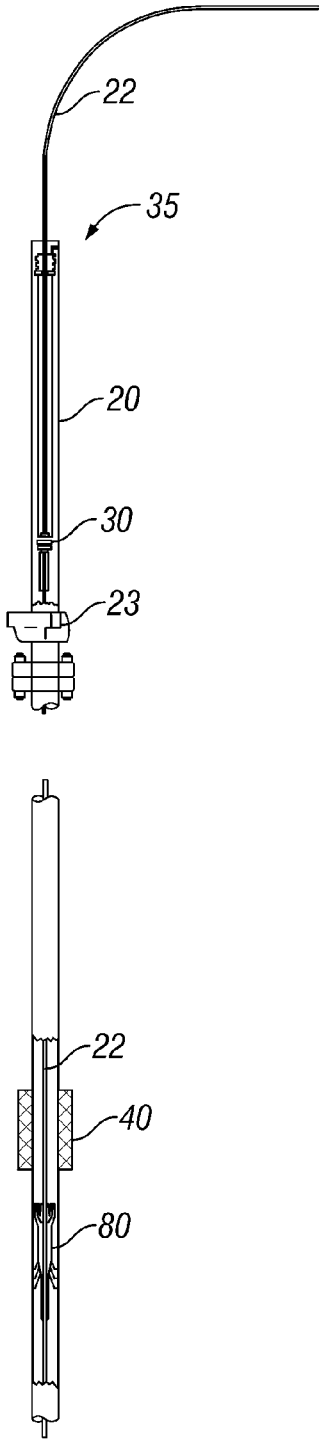
FIG. 4 is a schematic view of an extraction device and slick stinger in the inserted position.
Figure 5:
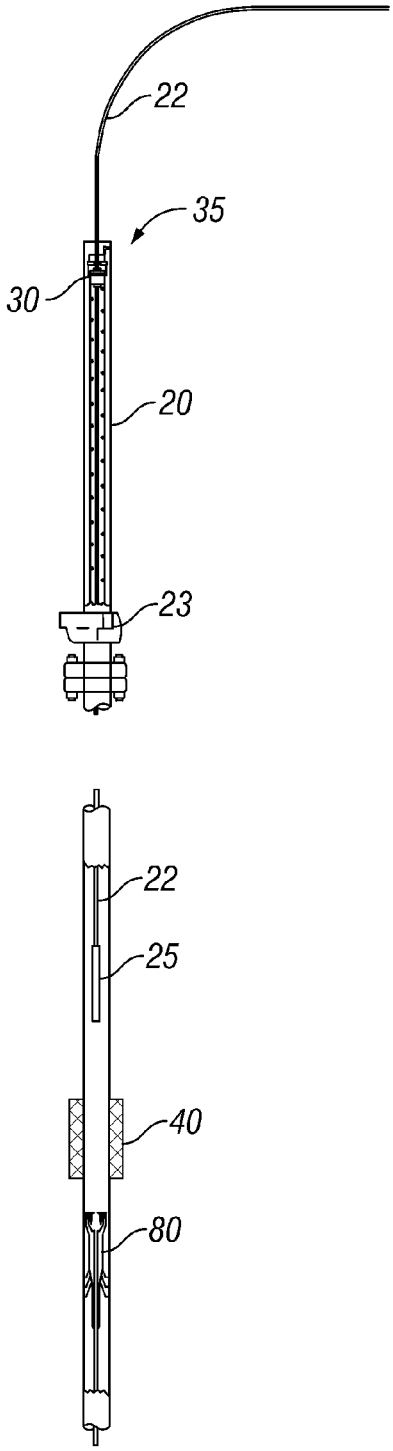
FIG. 5 is a schematic view of the extraction device and slick stinger in the withdrawn position.

FIG. 4 discloses the relative position of the elements of the present invention when the continuous hydraulic conduit is seated in the polished bore receptacle of tubing hanger 80. Hydraulic pressure is delivered by the control panel 10 to hydraulic port 35 that moves the piston 30 down the cylinder of the extraction device 20, all as more clearly shown in FIG. 5. The hydraulic pressure that moves the piston and then holds it in position is connected to the continuously pressurized hydraulic line that holds the safety valve in an open position. This communicating connection of the hydraulic pressure and continual holding of the same pressure on the piston and the down hole safety valve is accomplished through control panel 10.

Figure 6:
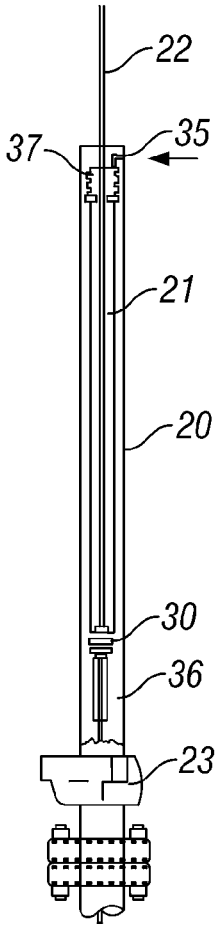
FIG. 6 is a schematic view of the extraction device mounted on a wellhead with a knock off connector in the inserted position.
Figure 7:
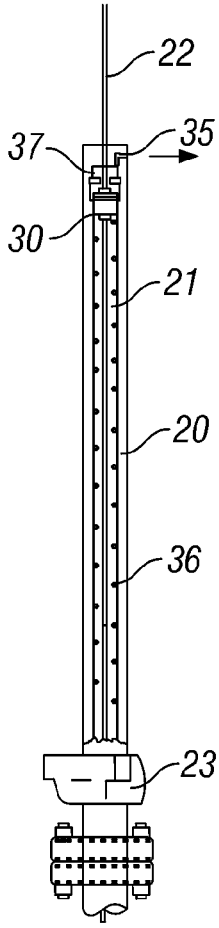
FIG. 7 is a schematic view of the extraction device mounted on a wellhead with a knock off connector in the withdrawn position.

FIG. 6 is a closer view of the extraction device 20 of the present invention with the spring or resilient member 36 in a compressed state, resulting from the introduction of hydraulic pressure through port 35 to the cylinder 21 thereby driving the sealing piston 30, together with the first continuous hydraulic conduit 22 carried therein, down into the well bore, through connector 22. As pressure is introduced into the hydraulic side of the piston, piston 30 is driven to compress the spring 36, shown in FIG. 7 in its uncompressed state. A second resilient member or spring 37 may be inserted at the end of the cylinder 21 to act as a shock absorber to prevent damage to the tool resulting from expected hydraulic pressure loss within the cylinder 21 of the extraction device 20. FIG. 6 shows this shock-absorbing spring 37 in its relaxed state because the piston 30 is in compression against spring 36; and FIG. 7 shows this shock-absorbing spring in its compressed state absorbing the upward pressure of the piston 30 as hydraulic pressure through port 35 is lessened.

At the installation of the tubing hanger 80, hydraulic conduit 22 is connected to the setting stinger 25 and hydraulic pressure is increased to set a latch in the tubing hanger 80. The tubing hanger has been previously prepared with a second small diameter hydraulic conduit hung below it down into the well which was attached to the tubing hanger by means well known to those skilled in the art, such as by Swage-Lok assemblies or the like, by way of example only. This second hydraulic conduit and tubing hanger after being connected to the first hydraulic conduit are lowered into the well bore to a point below the well valve which selectively controls the flow of fluid through the tubular bore. Once the desired location for tubing hanger 80 is reached, pressure is reduced from surface by manipulation of the controls in control panel 10 to bleed pressure from the tube disposed in the well which thereby permits the slips on tubing hanger to move into engagement with the interior surface of the tubular member into which this tubing hanger was inserted. The weight of the second continuous hydraulic conduit sets against the slips causing them to bite into the interior surface of the tubular member. The first continuous hydraulic conduit may then be fully withdrawn. A production stinger 25A with a longitudinal passage can then be inserted into the polished bore receptacle of the tubing hanger to allow fluid communication from the surface to the production zone in the well, as desired.

During installation, since it is unknown or, at a minimum, unproven at what depth well valve 40 is located, control panel 10 can be used to close valve 40. Thereafter, the first continuous hydraulic conduit 22 can be lowered or pumped down the well bore until it is stopped by the closed valve 40. The operator can then register the depth of valve 40 and thereafter withdraw first hydraulic conduit 22, attach a setting stinger 25 and tubing hanger 80, latch the first hydraulic conduit 22 into the tubing hanger 80 and lower the entire assembly into the well bore. Since the exact location of the well valve 40 is now known, the tubing hanger may be set adjacent and below well valve 40. The travel of the piston in the extraction device 20 must be gauged to allow a production stinger 25A to be removed from the tubing hanger 80 and polished bore by movement of the piston 30 in the extraction device 20.

Figure 8A:
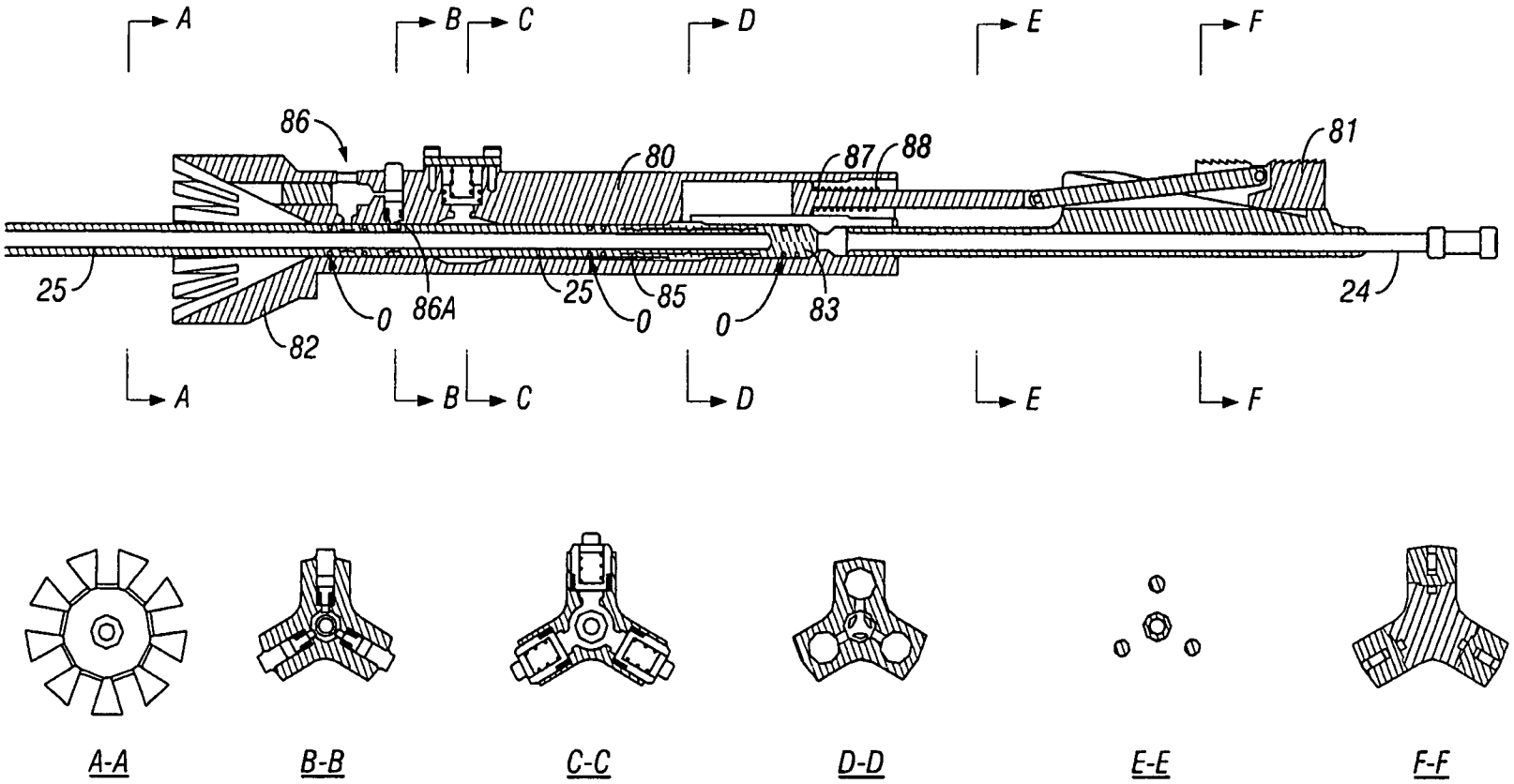
FIG. 8A is a cross-sectional side view of the tubing hanger including six cross-sectional end views of the hanger with the setting stinger engaged under pressure.

FIGS. 8A–8D show the details of the tubing hanger-polished bore receptacle. FIG. 8A is a composite view of the tubing hanger along with six cross-sectional end views; one from the top (A—A) showing the enlarged upper throat 82 allowing the insertion of the stinger into the polished bore to be readily accomplished. As noted the upper throat 82 of the tubing hanger 80 provides numerous flow paths so that fluids may readily flow past the tubing hanger. This upper throat 82 is bowl shaped to catch the production stinger 25 as it is lowered into the tubing hanger polished bore 85 of the tubing hanger 80. As may be readily appreciated, the downhole connection can alternatively be accomplished by providing a enlarged throat on the distal end of the first hydraulic line with a open path stinger attached to a tubing hanger such that the production stinger is oriented toward the wellhead.

The lower end view of FIG. 8A shows the setting tool with pressure engaged. The cross-sectional view of FIG. 8A through the line A—A shows the enlarged upper throat of the tubing hanger. The cross-sectional view of FIG. 8A through the line B—B shows the latching piston in the engaged position allowing the setting. FIG. 8A shows the tubing hanger as it goes into the well bore.

Figure 8B:
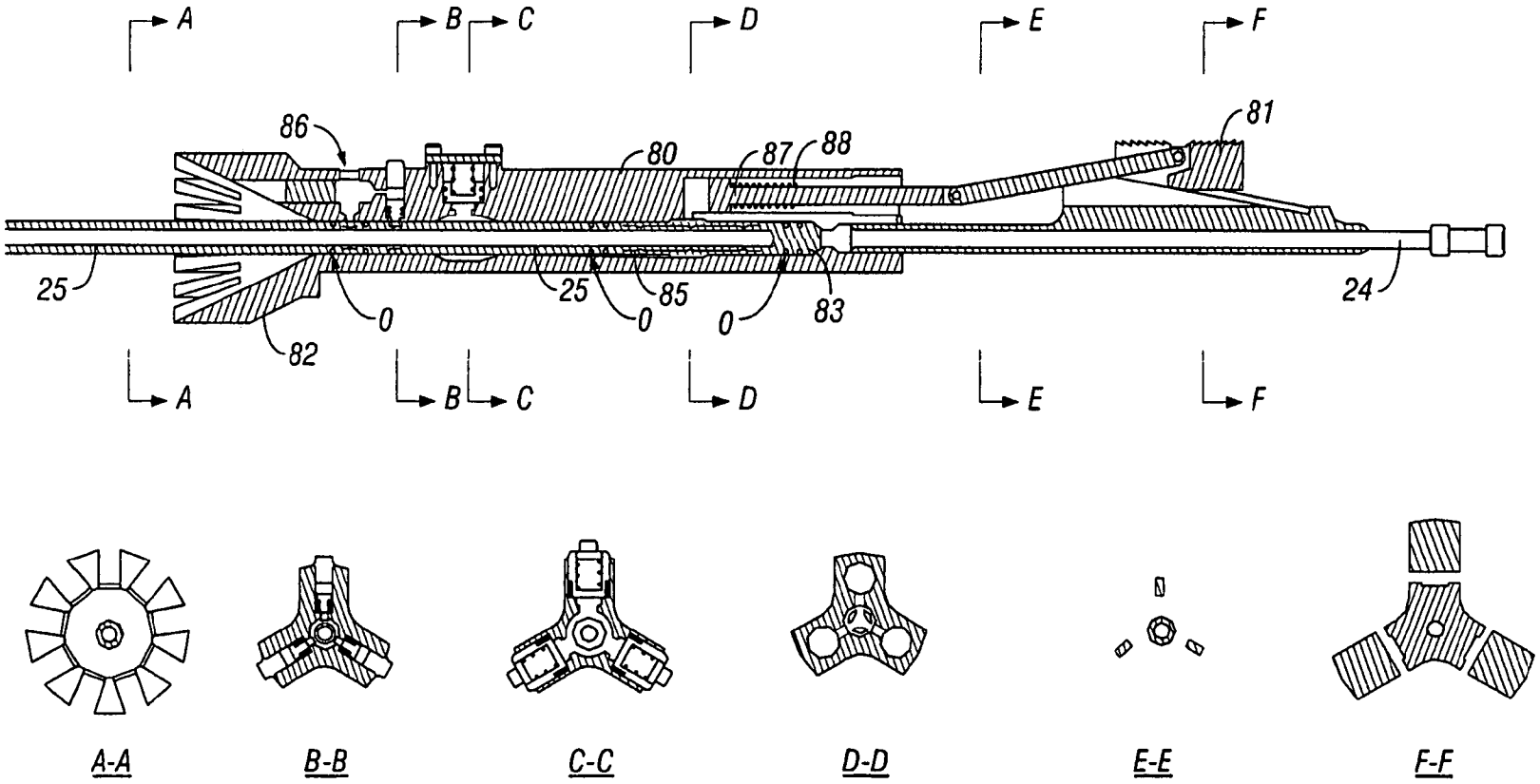
FIG. 8B is a cross-sectional view of the tubing hanger including six cross-sectional end views of the hanger with the hydraulic pressure released engaging the tool.

Pressure is exerted through the first hydraulic conduit 22 into the setting stinger 25 attached to its distal end that provides a bull nose 83. Tubing hanger 80 affixes a second continuous hydraulic conduit 24 that is attached in hanger 80 in the tubing string. The internal pressure from the first hydraulic conduit 22 enters hydraulic port 86 that thereby engages a latch 86A into a profile on the external lateral surface of the setting stinger 25. The setting stinger 25 as more fully shown in the drawings provides a plurality of elastomeric elements O or O-rings, which dynamically engage the inner surface of the polished bore receptacle 85 of the tubing hanger 80 to sealingly engage the tubing hanger. Internal pressure from the first hydraulic conduit 22 also keeps the piston 87 in full extension thereby preventing the slips 81 from moving into contact with the interior lateral wall of the tubular member. When the pressure is reduced as shown in FIG. 8B, spring 88 moves slips 81 into engagement with said wall and releases the latch 86A. The weight of the second continuous hydraulic conduit 24, in conjunction with the energy of spring 88, urges slips 81 to bite into the lateral interior wall of the tubular and set slips 81.

Figure 8C:
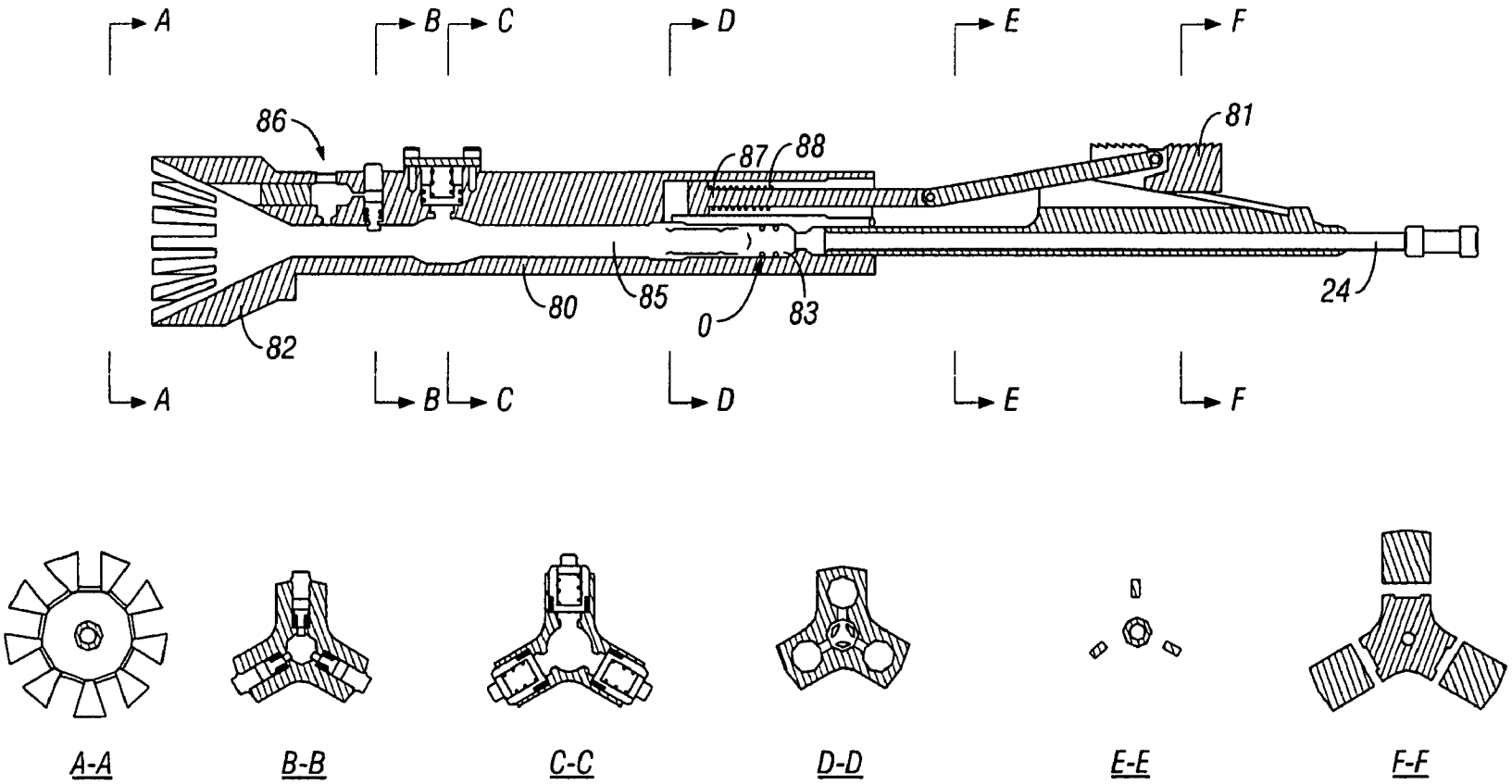
FIG. 8C is a cross-sectional view of the tubing hanger including six cross-sectional end views of the hanger released from the setting stinger.

The setting stinger 25 is then removed leaving the tubing hanger 80 as shown in FIG. 8C. Thereafter, a production stinger 25A having a longitudinal passageway to permit open communication from the surface hydraulic pumps through the first continuous hydraulic conduit 22 to the production zone serviced by the second continuous hydraulic conduit 24 suspended in the tubing hanger 80 of the present invention.

Figure 8D:
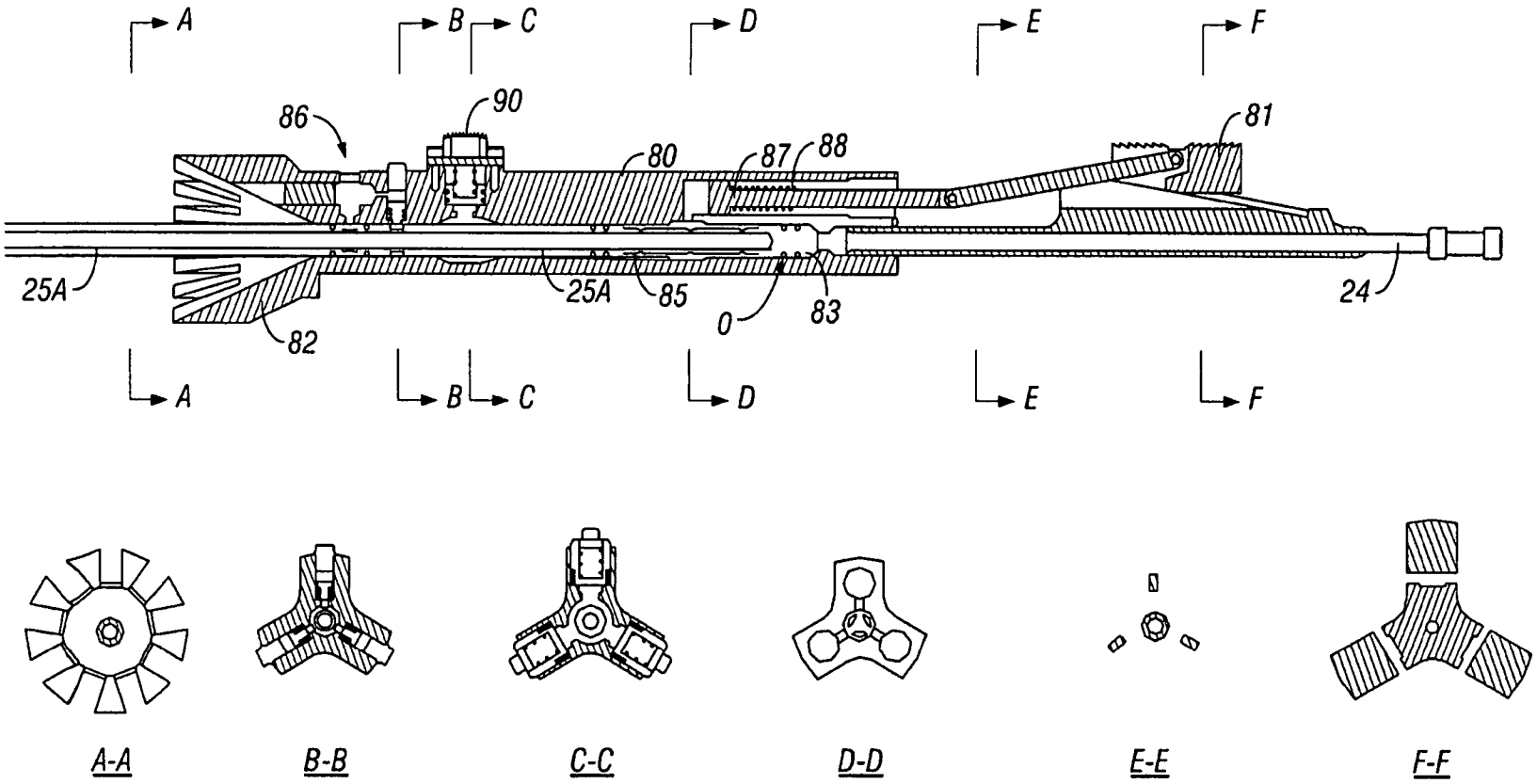
FIG. 8D is a cross-sectional view of the tubing hanger including six cross-sectional end views of the hanger connected to the setting stinger with pressure applied to set the secondary slips.

As additionally shown in FIG. 8D, through the line C—C, an additional slip set 90 can be set to hold the tubing hanger 80 in the well bore. Slip set 90 can be activated by a hydraulic pressure communicating port to a piston for driving the slip into engagement as shown in the drawing.

If the well valves must be closed for any reason, control panel 10 activates hydraulic port 35 to release the pressure on the resilient member 36 which immediately removes the first continuous hydraulic conduit and the attached stinger through the well valve 40 to be closed and thereby allowing control panel 10 to hydraulically close valve 40. As an additional feature, the production stinger 25A could be fabricated from a frangible material, such as a ceramic or the like, to permit the well valve to completely close on the stinger in the event the extraction device failed to withdraw the stinger from the tubing hanger in a timely manner.

Figure 9:
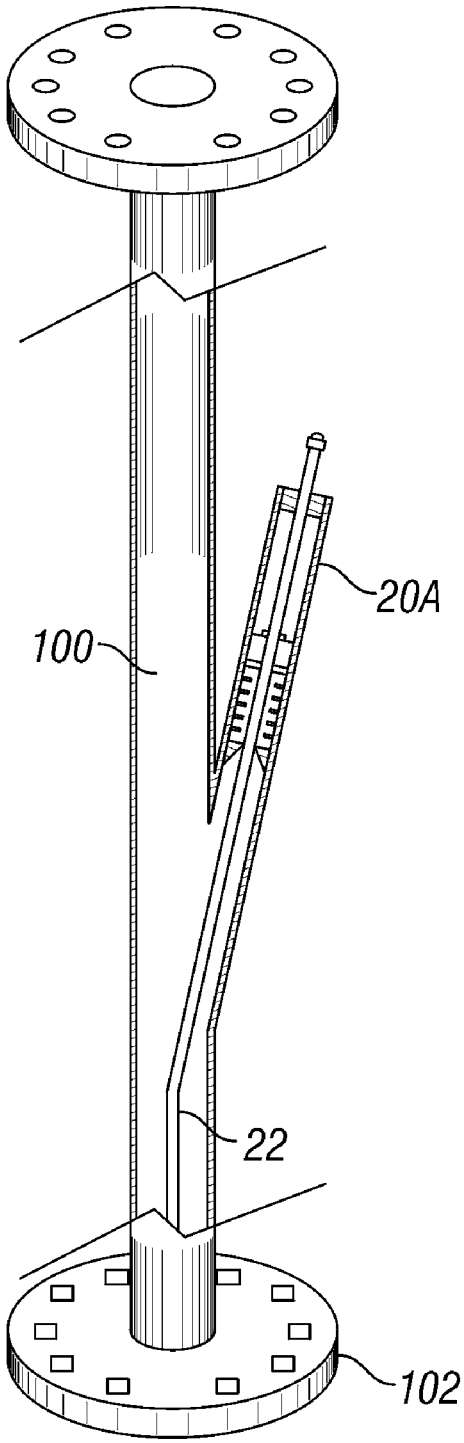
FIG. 9 is a schematic cross-sectional view of an alternative embodiment of a side-entry spool for wellhead insertion of a small diameter hydraulic conduit into a well.

An alternative embodiment can be utilized for wells only having a series of master valves on the surface for controlling the well. For example as shown in FIG. 9, a Y-shaped or side-entry spool 100 can be inserted between the wellhead and one of the master valves. If this side-entry spool 100 is to be inserted directly on the wellhead at 102, the operator could shut in the well by plugging the well at a profile usually located in the wellhead assembly below the primary or first master valve, in a manner well known to those in this industry. Alternatively, If the operator chooses to locate the side-entry spool 100 above the primary or first master valve, that master valve could be closed to control the well while the remainder of the production wellhead is removed and the side-entry spool 100 inserted. The need to close the primary or first master valve is minimized since the secondary master valve located above the side-entry spool can be used to close the well if excessive pressure is experienced.

If the operator desires, a tubing hanger can be set in a profile normally provided in a wellhead below the primary or first master valve to suspend a second small diameter continuous hydraulic. Once the tubing hanger is set in this profile in a manner well known in this industry, the operation of the extraction device could be readily accomplished as described above. The spool 100 would then work in the same manner as the extraction device 20 shown in FIG. 1.

Although an apparatus and method is disclosed enabling a single hydraulic conduit to be installed through a downhole valve, it should be understood by one skilled in the art that the embodiments and particular structures disclosed may be modified to allow for the passage of two or more hydraulic conduits through a downhole valve. Additionally, the methods disclosed can be performed using larger diameter pipe and tubing, either jointed or continuous.

Figure 10:
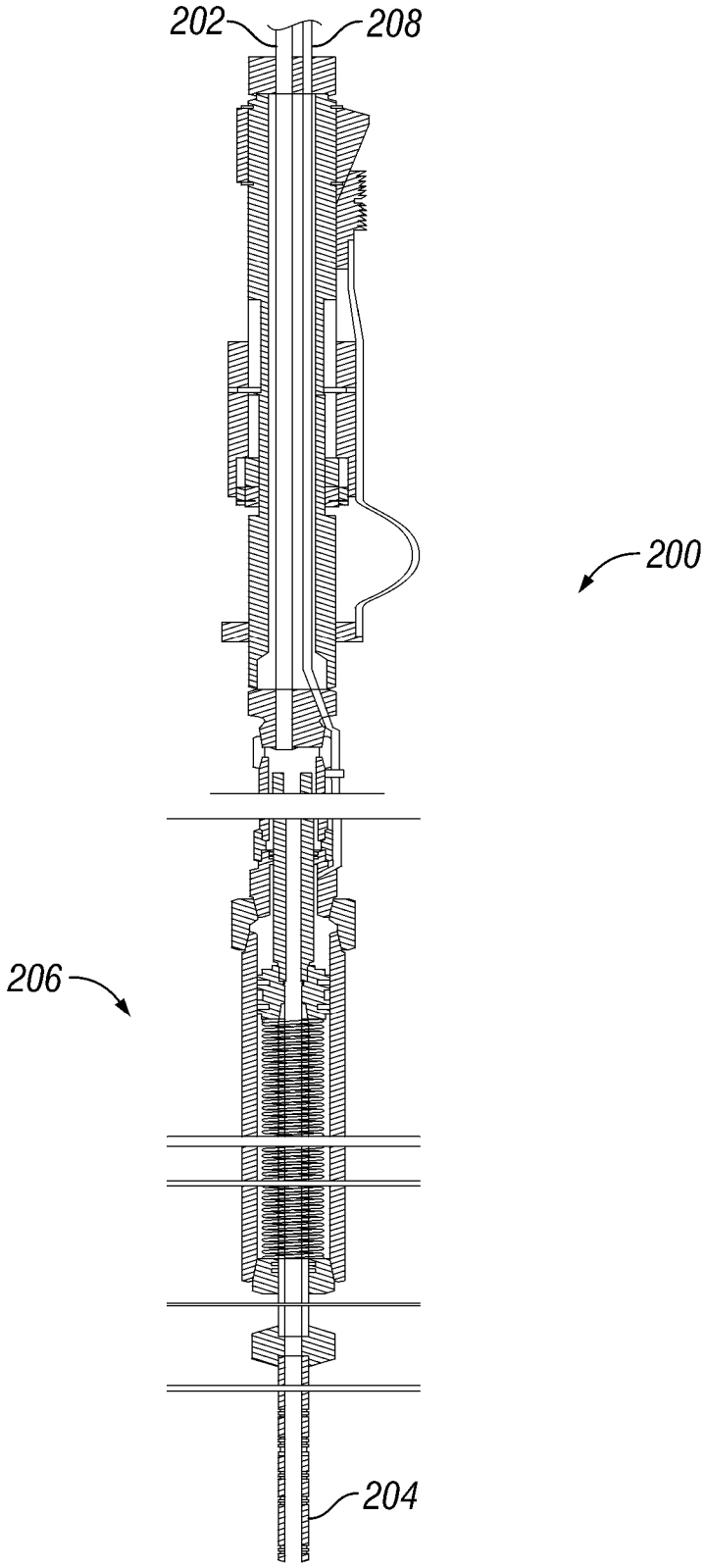
FIG. 10 is a cross-sectional view drawing of a tubing hanger assembly having an integral extraction device in accordance with an alternative embodiment of the present invention.

Referring now to FIG. 10, an alternative embodiment for a tubing hanger assembly 200 is shown. Tubing hanger assembly 200 is capable of delivering a continuous conduit 202 through a downhole safety valve (not shown) through a stinger 204. Furthermore, tubing hanger assembly 200 includes a downhole retractor assembly 206 that is hydraulically charged through hydraulic conduit 208. Tubing hanger assembly 200 is preferably configured to stab a hanger sub (like hanger 80 of FIGS. 2–8) located below a downhole safety valve. When hydraulic pressure (preferably pressurized nitrogen gas) is released from hanger assembly 200 retractor assembly 206 retracts and stinger 204 is retracted from hanger 80 and away from safety valve. With stinger clear of safety valve, the valve is free to close without obstructions. The assembly is preferably constructed as a fail-safe system, one whereby losses in pressure resulting, from, for example, pump failures, retract the stinger and close the safety valve.

Figure 11:
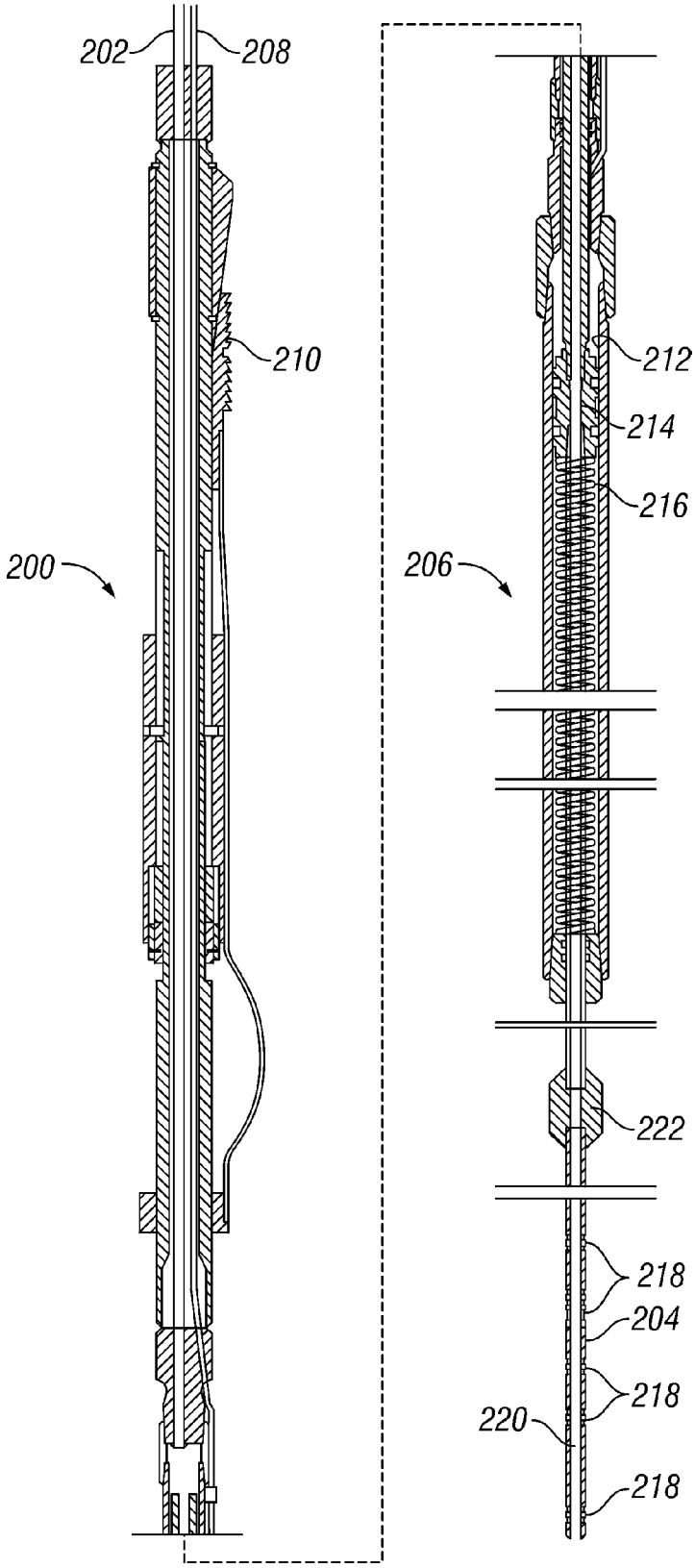
FIG. 11 is a close-up cross sectional drawing of the tubing hanger assembly of FIG. 10.

Referring now to FIG 11, the hanger assembly 200 is shown in more detail. To set the system in place, hanger assembly 200 is preferably deployed down production tubing (or a wellbore) with stinger 204 in retracted position and with slips 210 retracted. To extend stinger 204, hydraulic pressure is applied within conduit 208 which, in turn, is in communications with cylinder 212. Pressure within cylinder 212 thereby acts upon piston 214 thrusting it downhole compressing retraction spring 216. Stinger 204 is mechanically connected to piston 214 so pressure in cylinder 212 displaces piston 214 and thereby extends stinger 204.

With stinger 204 extended, assembly 200 is engaged into the well until the hanger receptacle (80 of FIGS. 8A–8D) is engaged. Stinger 204, preferably includes elastomeric seals 218 about its outer profile so that stinger 204 can sealingly engage seal bore (85 of FIG. 8C). A central bore 220 in fluid communication with conduit 202 allows fluids flowed therethrough to be delivered from the surface through hanger receptacle 80 and through any additional conduit further hung therefrom. Alignment guide 222 matches the profile of upper throat (82 of FIG. 8A) to allow for proper alignment therewith.

Once slips 210 are extended, stinger 204 can be extend thereby locking assembly 200 in place within the production string. This can be accomplished by any means already known in the art, but may be activated hydraulically or by axially loading assembly 200. With slips 210 set and stinger 204 extended and properly received by hanger receptacle 80, the system is ready for use. Should an event arise where the safety valve (located along tubular member between retractor 206 and stinger 204) needs to be closed, pressure within conduit 208 is released, causing retraction springs 216 to displace piston 214 upstream and retract stinger 204 attached thereto. Assembly 200 is preferably positioned such that the retraction of stinger 204 is enough to clear stinger 204 from hanger receptacle 80 and from safety valve.

Those familiar with well completions may readily substitute many well-known tubing hangers or utilize various setting methods which will accomplish the task of setting a hanger and suspending a tubular member below. The present invention for assembly of a continuous hydraulic conduit below a well valve while retaining the capacity for extracting a portion of the hydraulic conduit above the well valve to permit its closure can be practiced with these other well known tubing hanger assemblies and methods for setting them in a well without departing from the spirit or intent of this invention.

One skilled in the art will realize that the embodiments disclosed are illustrative only and that the scope and content of the invention is to be determined by the scope of the claims attached hereto.

What is claimed is:

1. A tubing hanger comprising:

an elongated body;

an attachment means for attaching the body to a radially adjoining surface in a downhole surface-controlled safety valve, the radially adjoining surface being fluidically isolated from the earth's surface by a closure mechanism of the downhole surface-controlled safety valve; and a capillary tubing suspended from the body to a location of interest in a wellbore.

2. The tubing hanger of claim 1 wherein a check valve for prohibiting flow of a wellbore fluid to the earth's surface is attached to the capillary tubing.

3. A tubing hanger comprising:

an elongated body;

an attachment means for attaching the body to a radially adjoining surface adjacent a lower end of a downhole surface-controlled safety valve, the radially adjoining surface being fluidically isolated from the earth's surface by a closure mechanism of the downhole surface-controlled safety valve; and a capillary tube suspended from the body to a location of interest in a wellbore.

4. A tubing hanger comprising:

an elongated body, the elongated body having an upper throat adapted to receive a stinger;

an attachment means for attaching the body to a radially adjoining surface below a downhole surface-controlled safety valve, the radially adjoining surface being fluidically isolated from the earth's surface by a closure mechanism of the downhole surface-controlled safety valve; and a capillary tubing suspended from the body to a location of interest in a wellbore.

5. The tubing hanger as in either claim 1, claim 3, or claim 4 in which the elongated body is tubing retrievable.

6. The tubing hanger as in either claim 1, claim 3, or claim 4 in which the elongated body is wireline retrievable.

7. A method of setting a tubing hanger in a wellbore comprising:

lowering a first length of a capillary tubing in the wellbore;

attaching the capillary tubing to a tubing hanger, creating an assembly;

lowering said assembly to a retrievable downhole surface-controlled safety valve; and landing and attaching the tubing hanger in the retrievable downhole surface-controlled safety valve at a location fluidically isolated from the earth's surface by a closure mechanism of the tubing retrievable downhole surface-controlled safety valve.

8. A method of setting a tubing hanger in a wellbore comprising:

lowering a first length of a capillary tubing in the wellbore;

attaching the capillary tubing to a tubing hanger, creating an assembly;

lowering said assembly to a retrievable downhole surface-controlled safety valve having an upper end and a lower end; and landing and attaching the tubing hanger to a radially interior surface adjacent the lower end of the retrievable downhole surface-controlled safety valve at a location fluidically isolated from the earth's surface by a closure mechanism of the retrievable downhole surface-controlled safety valve.

9. A method of artificially lifting a well having a downhole surface-controlled safety valve comprising:

utilizing a tubing hanger to suspend an upper end of a first capillary tubing in the well at a location fluidically isolated from the earth's surface by a closure mechanism of the downhole surface-controlled safety valve;

conveying a lower end of the first capillary tubing to a location of interest in the well;

connecting a lower end of a second capillary tubing to the tubing hanger, wherein the second capillary tubing is in fluid communication with the first capillary tubing; and injecting a fluid from the earth's surface inside the second capillary tubing through the tubing hanger to the first capillary tubing.

10. A method of communicating from the earth's surface to a location of interest in a well comprising:

utilizing a tubing hanger to suspend an upper end of a first capillary tubing in the well at a location fluidically isolated from the earth's surface by a closure mechanism of a downhole surface-controlled safety valve;

conveying a lower end of the first capillary tubing to the location of interest in the well;

connecting a lower end of a second capillary tubing to the tubing hanger, wherein the second capillary tubing is in fluid communication with the first capillary tubing; and communicating with the earth's surface inside the second capillary tubing through the tubing hanger to the first capillary tubing.

* * * * *